US006257965B1

(12) United States Patent
Kamikubo et al.

(10) Patent No.: US 6,257,965 B1
(45) Date of Patent: Jul. 10, 2001

(54) POLISHING LIQUID SUPPLY APPARATUS

(75) Inventors: Noritaka Kamikubo, Osaka; Yuji Satoh, Fukuyama, both of (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 09/471,809

(22) Filed: Dec. 23, 1999

(30) Foreign Application Priority Data

Dec. 24, 1998 (JP) ..... 10-365844

(51) Int. Cl.[7] ..... B24B 7/19; B24B 7/30
(52) U.S. Cl. ..... 451/60; 451/446
(58) Field of Search ..... 451/446, 36, 37, 451/41, 67, 60, 285–290; 156/345

(56) References Cited

U.S. PATENT DOCUMENTS 6,053,158 * 4/2000 Miyata et al. ..... 451/60
6,059,920 * 5/2000 Nojo et al. ..... 451/60

FOREIGN PATENT DOCUMENTS 7-233933 9/1995 (JP) .
9-131660 5/1997 (JP) .
131660 * 5/1997 (JP) ..... 451/60
410326769 * 12/1998 (JP) ..... 451/60

* cited by examiner

*Primary Examiner*—Derris H. Banks
(74) *Attorney, Agent, or Firm*—Nixon & Vanderhye, P.C.

(57) ABSTRACT

A polishing liquid supply apparatus for supplying a polishing liquid to a chemical mechanical polishing apparatus includes a polishing liquid supply system including a polishing liquid tank for storing the polishing liquid; and a polishing liquid supply path for supplying the polishing liquid from the polishing liquid tank to the chemical mechanical polishing apparatus. The polishing liquid supply system is structured so as to shield the polishing liquid therein from external air.

17 Claims, 6 Drawing Sheets

POLISHING LIQUID SUPPLY APPARATUS

BACKGROUND OF THE INVENTION

1. Field of the Invention

The present invention relates to a polishing liquid supply apparatus usable for a chemical mechanical polishing (CMP) apparatus, which is usable in a semiconductor device production process for smoothing a surface of a semiconductor device.

2. Description of the Related Art

In response to the increasing degree of integration, it has become increasingly important to smooth a surface of a wafer of a semiconductor device during the production process thereof. The wafer surface can be smoothed by a CMP apparatus. When the CMP apparatus is used, the wafer surface can be smoothed by a chemical mechanical polishing method which utilizes an interaction of mechanical polishing by a polishing pad and a polishing agent contained in the polishing liquid or slurry and chemical etching by a solution of slurry.

Recently, a so-called dicing machine method and a trench method have been widely used, by which a patterned film is buried in a wafer formed of a metal, dielectric or other material which is different from the material of the film, and the film is treated with chemical mechanical polishing. As a result, a wafer having a desired pattern of film buried therein is formed.

In such chemical mechanical polishing, the chemical properties of a polishing liquid used need to be strictly controlled in such a manner that the rate of polishing the film material is appropriate. The pH of the polishing liquid, which is closely related to the polishing speed, is especially important.

Conventionally, there is an attempt to stabilize the amount of the polishing liquid supplied to a chemical mechanical polishing apparatus from a polishing liquid supply system.

For example, Japanese Laid-Open Publication No. 9-131660 describes a semiconductor device production apparatus 700 as shown in FIG. 7 including a chemical mechanical polishing apparatus. The semiconductor device production apparatus 700 includes a polishing liquid tank 701 for storing a polishing liquid 2 used for polishing a semiconductor wafer or the like, crude polishing liquid tanks 713*a* and 713*b* connected to the polishing liquid tank 701 respectively through pipes 711*a* and 711*b* and pumps 712*a* and 712*b*, a chemical mechanical polishing apparatus 716 connected to the polishing liquid tank 701 through a pipe 709 and a pump 710, and a waste liquid treating apparatus 717 connected to the polishing liquid tank 701 through a pipe 714 and a pump 715.

The polishing liquid tank 701 accommodates a liquid level sensor 704 for measuring the amount of the polishing liquid 2 and a stirring device 708 for appropriately stirring the polishing liquid 2. A control section 707 is connected to the liquid level sensor 704, the stirring device 708, and a pH sensor (not shown) accommodated in the chemical mechanical polishing apparatus 716. The pH sensor is provided on an adsorption plate (not shown) for adsorbing a wafer accommodated in the chemical mechanical polishing apparatus 716. The polishing liquid 2 in the polishing liquid tank 701 is supplied to the chemical mechanical polishing apparatus 716 by the pump 710 through the pipe 709.

Before the wafer is polished, the pH sensor measures the pH of the polishing liquid 2. The driving amount of the pump 710 is adjusted based on the pH measured, and thus the amount of the supplied polishing liquid 2 is controlled.

Japanese Laid-Open Publication No. 7-233933 describes a polishing liquid supply apparatus 800 shown in FIG. 8. The polishing liquid supply apparatus 800 includes a mixer 801 for mixing the polishing liquid 2 with an additive liquid, a polishing liquid tank 802 connected to the mixer 801, an additive liquid supply pipe 806 for supplying the additive liquid to the mixer 801 via a control valve 807, and two detection pipes 811 and 812 inserted into the polishing liquid tank 802 at a level difference of H. The detection pipes 811 and 812 respectively have air injection holes at bottom ends 813 and 814 thereof. The polishing liquid supply apparatus 800 further includes an air supply source 815 for supplying air to top ends of the detection pipes 811 and 812 at certain pressures respectively, a differential pressure detector 818 for detecting a difference in the air pressure between the detection pipes 811 and 812, and a control device 819 for controlling the opening angle of the control valve 807. When the difference in the air pressure detected by the differential pressure detector 818 is larger than a set value 820, the control device 819 increases the opening angle of the control valve 807; and when the difference in the air pressure detected by the differential pressure detector 818 is smaller than a set value 820, the control device 819 decreases the opening angle of the control valve 807.

The concentration of the polishing liquid 2 in the polishing liquid tank 802 is controlled by adjusting, by controlling the control valve 807, the amount of the additive liquid supplied to the mixer 801 based on the difference in the air pressure detected by the differential pressure detector 818.

The chemical mechanical polishing system 700 shown in FIG. 7 has the following problem. A portion for coupling the pipe 709 to the polishing liquid tank 701 and a portion for coupling the pipes 711*a* and 711*b* to the polishing liquid tank 701 do not have a structure for blocking the external air. Due to such a structure, a gas 703 contained in the polishing liquid tank 701, which is adjusted to have an appropriate concentration to be used for polishing, is exposed to the external air. Accordingly, the external air invades into the polishing liquid tank 701.

The polishing liquid supply apparatus 800 shown in FIG. 8 has the following problem. External air invades into the polishing liquid tank 801 through the injection air holes at the bottom ends 813 and 814 of the detection pipes 811 and 812.

The following problem occurs when these apparatuses are used to perform chemical mechanical polishing. When, for example, a polishing liquid containing cerium oxide (ceria) or the like as a polishing agent is used, the polishing liquid deteriorates the polishing characteristics thereof over time due to the change in pH thereof in the polishing liquid tank. Although it is possible to adjust the pH by adding and mixing more polishing liquid, it is difficult to improve the polishing characteristics once they are deteriorated.

In chemical mechanical polishing, a difference in the polishing rate of films of two or more different materials to be polished can be utilized. In such a case, when the pH of the polishing liquid is 7, which indicates the liquid is neutral, the pH of the liquid may sometimes exceed 7 over time. Then, the polishing rates of the films to be polished and the difference in the polishing rate are significantly changed. Thus, the obtained polishing characteristics are far from the desirable characteristics. For example, when a polishing liquid containing cerium oxide is used for polishing a film containing silicon oxide ($SiO_2$) and silicon nitride ($Si_3N_4$) and the pH or the polishing liquid exceeds 7, a polishing rate 32 of an $Si_3N_4$ film increases as shown in FIG. 2 as well as a polishing rate 31 of an $SiO_2$ film, resulting in the $Si_3N_4$ film being unnecessarily polished.

In order to avoid such an undesirable effect, the capacity of the polishing liquid tank needs to be restricted so as to prevent the polishing liquid 2 from staying in the polishing liquid tank for an extended period of time. When the used amount of the polishing liquid 2 is excessively small, the polishing liquid 2 needs to be disposed of long before the life expectancy of the polishing liquid 2.

SUMMARY OF THE INVENTION

A polishing liquid supply apparatus according to the present invention for supplying a polishing liquid to a chemical mechanical polishing apparatus includes a polishing liquid supply system including a polishing liquid tank for storing the polishing liquid; and a polishing liquid supply path for supplying the polishing liquid from the polishing liquid tank to the chemical mechanical polishing apparatus. The polishing liquid supply system is structured so as to shield the polishing liquid therein from external air.

In one embodiment of the invention, the polishing liquid supply path is hermetically connected to the polishing liquid tank.

In one embodiment of the invention, the polishing liquid supply system is filled with an inert gas.

In one embodiment of the invention, the polishing liquid tank has a capacity that is variable depending on an amount of the polishing liquid in the polishing liquid tank.

In one embodiment of the invention, the polishing liquid tank accommodates a piston resting on a surface of a polishing liquid and moving upward and downward in accordance with a change in surface level of polishing liquid in the polishing liquid tank.

In one embodiment of the invention, the polishing liquid supply apparatus further includes a measuring device for measuring a pH of the polishing liquid in the polishing liquid tank and a control device for controlling a life expectancy of the polishing liquid based on the pH of the polishing liquid obtained by the measuring device.

Thus, the invention described herein makes possible the advantages of providing (1) a polishing liquid supply apparatus for stabilizing chemical mechanical polishing of a semiconductor device or the like by preventing the polishing liquid from contacting the external air and (2) a polishing liquid supply apparatus for performing chemical mechanical polishing at a lower cost by predicting the life expectancy of the polishing liquid.

These and other advantages of the present invention will become apparent to those skilled in the art upon reading and understanding the following detailed description with reference to the accompanying figures.

DESCRIPTION OF THE PREFERRED EMBODIMENTS

Hereinafter, the present invention will be described by way of illustrative examples with reference to the accompanying drawings.

EXAMPLE 1

Figure 1:
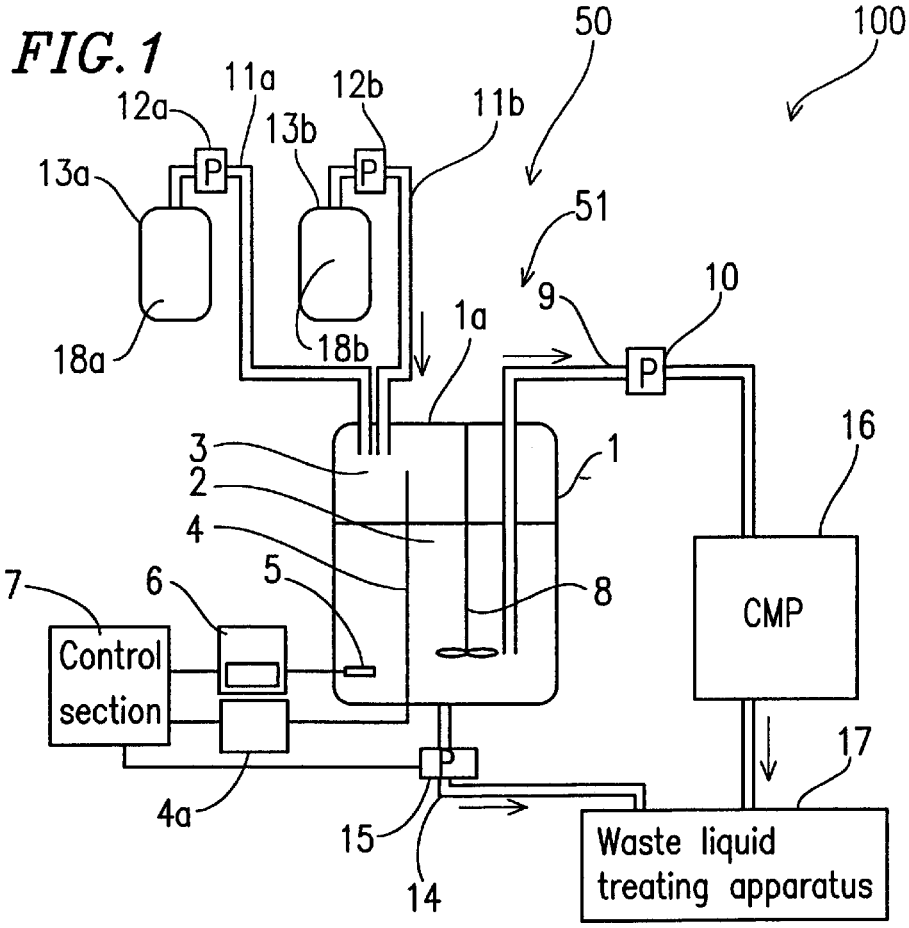
FIG. 1 is a schematic view of a semiconductor device production apparatus including a polishing liquid supply apparatus in a first example according to the present invention.

FIG. 1 is a schematic view of a semiconductor device production apparatus 100. The semiconductor device production apparatus 100 includes a polishing liquid supply apparatus 50 in a first example according to the present invention.

The polishing liquid supply apparatus 50 includes a polishing liquid tank 1 for storing a polishing liquid 2 used for polishing a semiconductor wafer or the like, crude polishing liquid tanks 13*a* and 13*b* connected to the polishing liquid tank 1 respectively through pipes 11a and 11*b* and pumps 12*a* and 12*b*.

A chemical mechanical polishing apparatus 16 is connected to the polishing liquid tank 1 through a pipe 9 and a pump 10, and a waste liquid treating apparatus 17 is connected to the polishing liquid tank 1 through a pipe 14 and a pump 15.

The polishing liquid tank 1, the pipes 9, 11*a*, and 11*b*, the pumps 10, 12*a* and 12*b*, and the crude polishing liquid tanks 13*a* and 13*b* are included in a polishing liquid supply system 51.

The polishing liquid tank 1 accommodates a liquid level sensor 4 for measuring the amount of the polishing liquid 2 and a stirring device 8 for appropriately stirring the polishing liquid 2.

The crude polishing liquid 18*a* contained in the crude polishing liquid tank 13*a* and the crude polishing liquid 18*b* contained in the crude polishing liquid tank 13*b* are supplied to the polishing liquid tank 1 respectively through the pipes 11*a* and 11*b*. The amounts of the crude polishing liquids 18*a* and 18*b* are controlled by the pumps 12*a* and 12*b* so that the liquids 18*a* and 18*b* are at a prescribed ratio. The polishing liquids 18*a* and 18*b* are mixed at an appropriate ratio with the polishing liquid 2 and stirred together in the polishing liquid tank 1 by the stirring device 8. The mixture of the polishing liquid 2 with the crude polishing liquids 18*a* and 18*b* will also be referred to as the "polishing liquid 2" for simplicity. The amount of the polishing liquid 2 is measured by the liquid level sensor 4. For chemical mechanical polishing, a necessary amount of the polishing liquid 2 is supplied to the chemical mechanical polishing apparatus 16 through the pipe 9. The necessary amount is controlled by the pump 10.

The polishing liquid tank 1 further accommodates a pH measuring device 5 for measuring the pH of the polishing liquid 2. The pH measuring device 5 is connected to a pH display 6 provided outside the polishing liquid tank 1. The pH display 6 is connected to a control section 7. The control section 7 is also connected to the liquid level sensor 4 through a liquid level sensor control section 4*a*. When the pH of the polishing liquid 2 obtained by the pH measuring device 5 exceeds a prescribed level, the polishing liquid 2 is discharged to a waste liquid treating apparatus 17 through the pump 15 and the pipe 14.

The pipes 11*a* and 11*b* are hermetically connected to a top plate la of the polishing liquid tank 1. Bottom ends of the pipes 11*a* and 11*b* are in an upper portion of the polishing liquid tank 1. The pipe 9 is also hermetically connected to the top plate 1*a* of the polishing liquid tank 1. A bottom end of the pipe 9 is in a lower portion of the polishing liquid tank 1. Due to such a structure, external air does not invade inside the polishing liquid tank 1.

Figure 2:
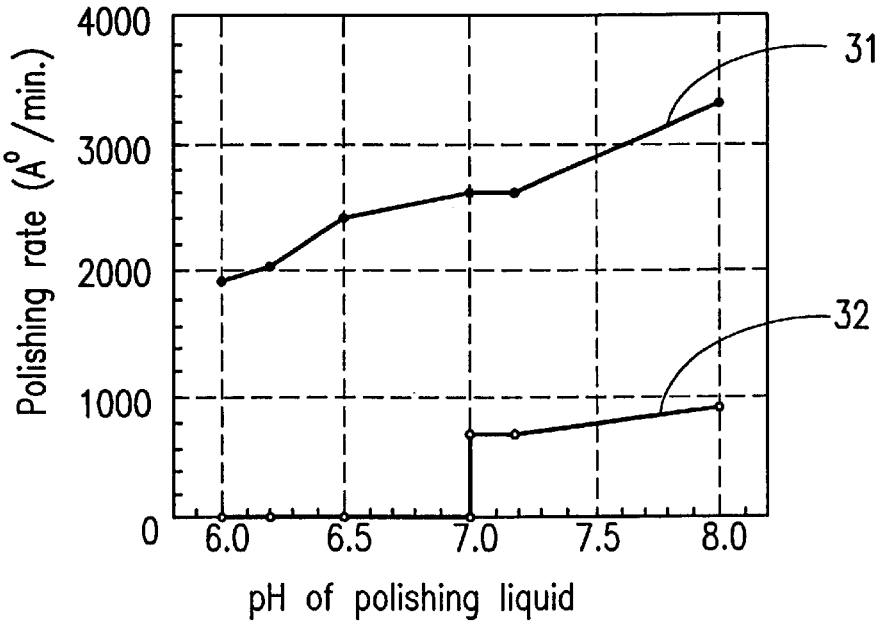
FIG. 2 is a graph illustrating exemplary relationships between the pH of a polishing liquid and polishing rates.

FIG. 2 is a graph illustrating exemplary relationships between the pH of a polishing liquid containing cerium oxide and polishing rates (Å/min.) of the polishing liquid relative to a $SiO_2$ film and an $Si_3N_4$ film. In FIG. 2, curve 31 represents the relationship between the pH of the polishing liquid and the polishing rate of the $SiO_2$ film; and curve 32 represents the relationship between the pH of the polishing liquid and the polishing rate of the $Si_3N_4$ film.

As shown in FIG. 2, the polishing rate 31 of the $SiO_2$ film and the polishing rate 32 of the $Si_3N_4$ film significantly depend on the pH of the polishing liquid. As described above, a difference in the polishing rate of films of two or more different materials can be utilized in chemical mechanical polishing to produce a desirable semiconductor device. The ratio of the polishing rate 31 to the polishing rate 32 needs to be as large as possible and; and in order to raise the polishing amount per unit time, the polishing rate 31 needs to be as high as possible.

With reference to FIG. 2, the pH of the polishing liquid containing cerium oxide is preferably in the range of about 6.0 to about 6.5. In this region where the polishing liquid containing cerium oxide is weak acid, the $SiO_2$ film is relatively easy to polish but the $Si_3N_4$ film is difficult to polish. When the pH exceeds 7, the polishing rate of the $Si_3N_4$ film significantly rises, resulting in the $Si_3N_4$ film being polished as well as the $SiO_2$ film. Since the chemical mechanical polishing characteristics greatly change when the pH of the polishing liquid is 7 (neutral) or higher, the polishing liquid having such a high pH cannot be used for chemical mechanical polishing.

Figure 3:
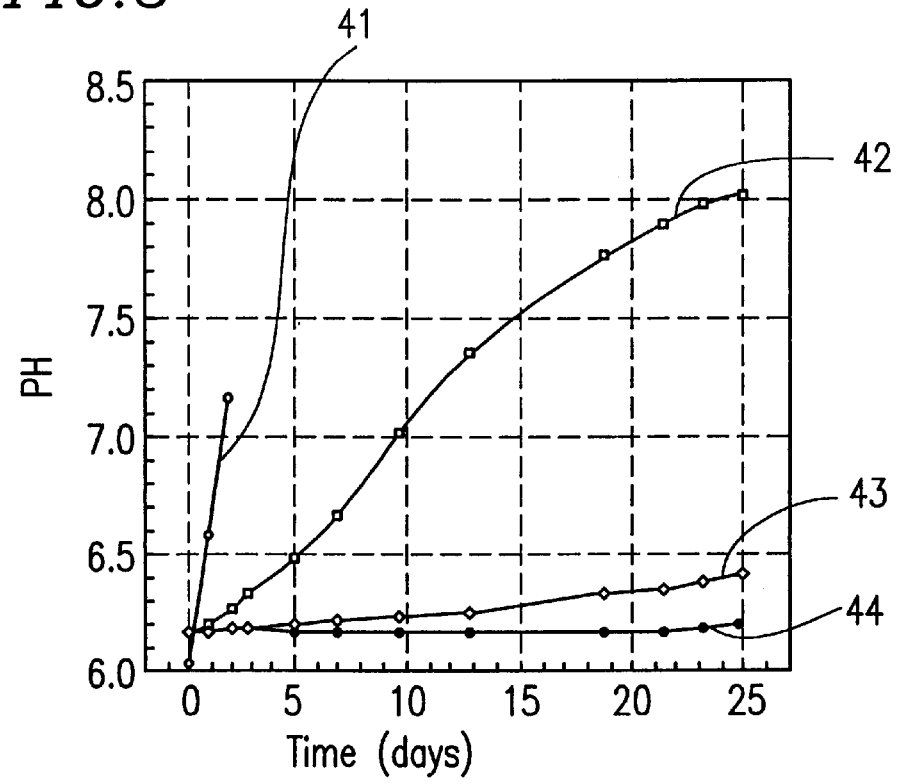
FIG. 3 is a graph illustrating an exemplary change over time in the pH of the polishing liquid containing cerium oxide with respect to the storage condition.

FIG. 3 is a graph illustrating an exemplary change over time in the pH of the polishing liquid containing cerium oxide with respect to the storage condition. In order to fulfill the above-described conditions, the pH of the polishing liquid immediately after the preparation thereof is adjusted to be about 6.0 to about 6.2.

In FIG. 3, curve 41 represents the change over time in a pH where the polishing liquid is not shielded from the external air (in a conventional chemical mechanical polishing system) and the polishing liquid is stirred. Curve 42 represents the change over time in a pH where the polishing liquid is not shielded from the external air and the polishing liquid is not stirred. Curve 43 represents the change over time in a pH where the polishing liquid is shielded from the external air and the polishing liquid is stirred (first example). Curve 44 represents the change over time in a pH where the polishing liquid is not exposed to gas or external air.

As can be appreciated from FIG. 3, the pH of the polishing liquid exceeds 7 within a few days when the polishing liquid is not shielded from the external air in the conventional apparatus (curve 41). Even when the polishing liquid is not stirred, the pH of the polishing liquid exceeds 7 in about 10 days where the polishing liquid is not shielded from the external air (curve 42). In the case where the polishing liquid is shielded from the external air as in this example, the pH of the polishing liquid is still about 6.4 even after 25 days (curve 43).

The pH of the crude polishing liquid also rises when not shielded from the external air in a similar manner as shown in FIG. 3.

The polishing liquid supply apparatus 50 having such a structure provides stable and reliable chemical mechanical polishing.

The provision of the pH measuring device 5, the pH display 6 and the control section 7 facilitates the control of the reliability of the polishing quality.

Figure 4:
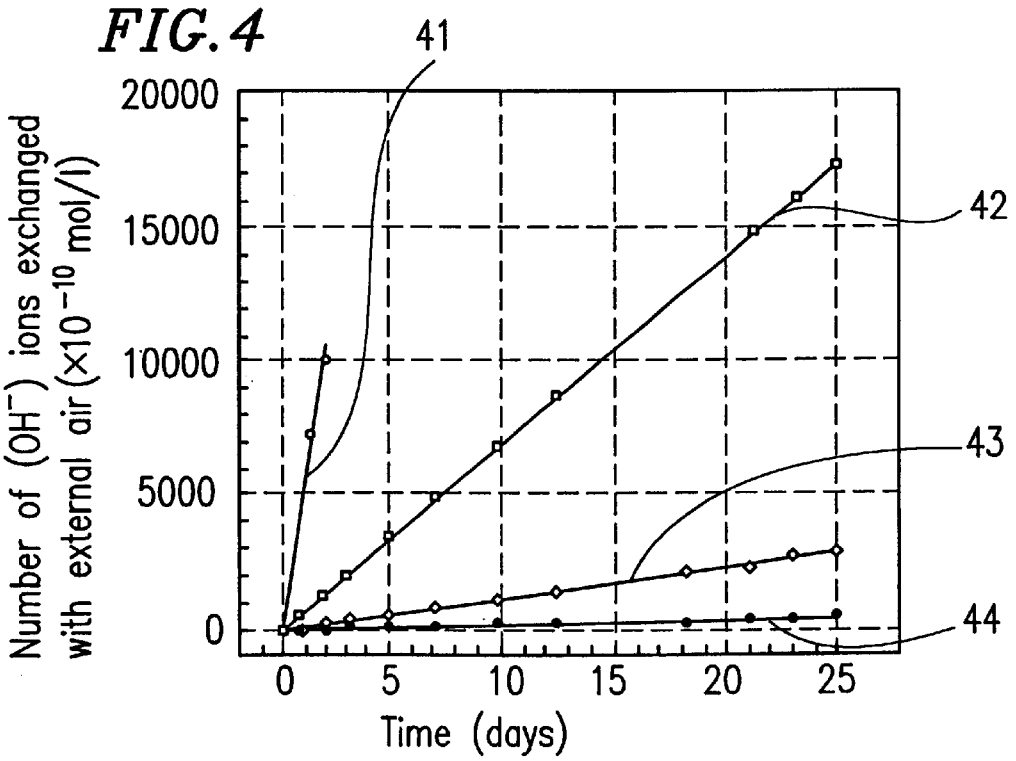
FIG. 4 is a graph illustrating the changes in the pH shown in FIG. 3 after conversion into the amount of hydroxide ions ($OH^-$) exchanged by the polishing liquid with the external air.

FIG. 4 is a graph illustrating the changes in the pH shown in FIG. 3 after conversion into the amount of hydroxide ions ($OH^-$) exchanged by the reaction of the polishing liquid with the external air. As can be appreciated from FIG. 4, the hydroxide ions in the same polishing liquid are exchanged at a substantially constant level in the same storage condition. In other words, each storage condition has a specific exchange ratio of hydroxide ions. Although FIG. 4 shows the changes in the pH as the amount of the hydroxide ions exchanged, the changes in the pH can also be shown as the amount of hydrogen ions ($H^+$). The exchange is performed in the opposite direction, but the amount of ions exchanged is the same.

The changes in the pH of the polishing liquid can be predicted by analyzing, in the control section 7, the pH of the polishing liquid measured by the pH measuring device 5. For example, the life expectancy of the polishing liquid, i.e., the time duration until the pH of the polishing liquid exceeds 7 so as to significantly change the polishing characteristics can be predicted. Since the polishing characteristics change at a substantially constant ratio as shown in FIG. 4, the life expectancy of the polishing liquid can be controlled more easily.

When the pH of the polishing liquid changes to a level at which the polishing liquid is not usable, the pump 15 (FIG. 1) is controlled to discharge the polishing liquid 2 from the polishing liquid tank 1. Thus, the chemical mechanical polishing can be continued without using the deteriorated polishing liquid.

Since the time duration in which the polishing liquid stays in the polishing liquid tank 1 after the polishing liquid 2 is prepared is predictable, the polishing liquid 2 needs to be discharged less frequently, which reduces the cost. Conventionally, the polishing liquid 2 is discharged about every 7 days regardless of the polishing liquid supply system. According to the present invention, the polishing liquid 2 is usable for the entire life expectancy specific to the size of the polishing liquid tank 1.

A specific experiment of supplying a polishing liquid containing cerium oxide in the polishing liquid supply apparatus 50 will be described.

The pH of the polishing liquid after being mixed with the crude polishing liquid was adjusted to be 6.17. The polishing rate of the $SiO_2$ film was 215 nm/min., and the polishing rate of the $Si_3N_4$ film was 1 nm/min. The ratio of the polishing rate of the $SiO_2$ film to the polishing rate of the $Si_3N_4$ film was 215. Thirty days later, the pH of the polishing liquid was 6.55, and the polishing rates of the $SiO_2$ film and the $Si_3N_4$film were respectively 260 nm/min. and 1 nm/min.

The ratio of the former to the latter was 260. As can be appreciated from these numerical figures, the polishing characteristics were stable. The life expectancy of the polishing liquid was about 60 days. Sufficiently stable and reliable polishing was performed without discharging the polishing liquid in 7 days.

EXAMPLE 2

Figure 5:
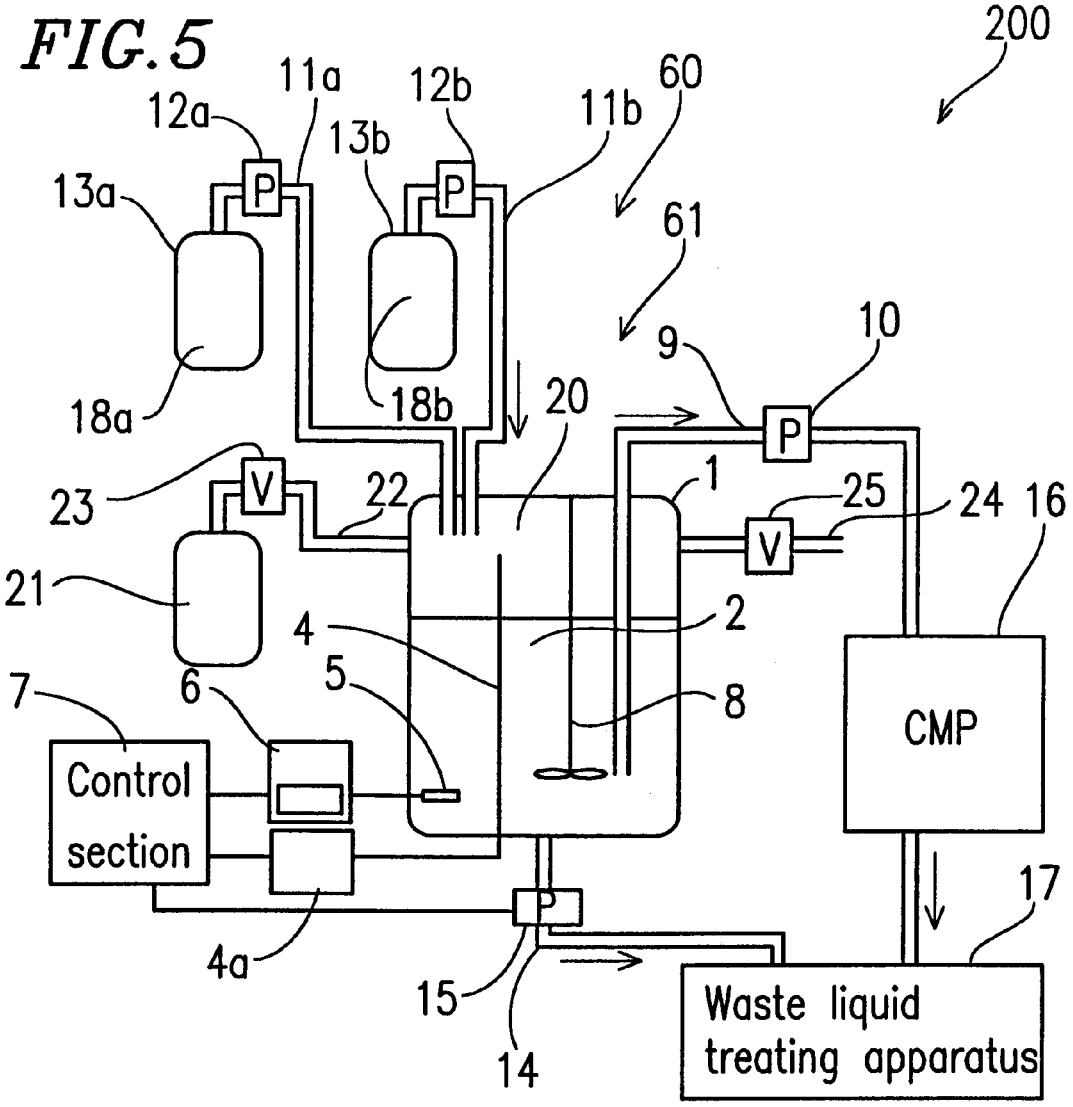
FIG. 5 is a schematic view of a semiconductor device production apparatus including a polishing liquid supply apparatus in a second example according to the present invention.

FIG. 5 is a schematic view of a semiconductor device production apparatus 200. The semiconductor device production apparatus 200 includes a polishing liquid supply apparatus 60 in a second example according to the present invention. Identical elements previously discussed with respect to FIG. 1 bear identical reference numerals and the descriptions thereof will be omitted.

The polishing liquid tank 1 accommodates an inert gas 20 of, for example, nitrogen or neon. For example, the inert gas 20 is supplied to the polishing liquid tank 1 from a cylinder 21 through a pipe 22 and a pressure adjusting valve 23 and discharged outside the semiconductor device production apparatus 200 through a pipe 24 and a pressure adjusting valve 25. When the pressure of the inert gas 20 in the polishing liquid tank 1 is less than a prescribed level, the pressure adjusting valve 23 is opened to fill the polishing liquid tank 1 with the inert gas; and when the pressure of the inert gas 20 in the polishing liquid tank 1 is more than the prescribed level, the pressure adjusting valve 25 is opened to discharge the inert gas 20.

The polishing liquid tank 1, the pipes 9, 11*a*, and 11*b*, the pumps 10, 12*a* and 12*b*, the crude polishing liquid tanks 13*a* and 13*b*, the cylinder 21, the pipe 22, and the pressure adjusting valve 23 are included in a polishing liquid supply system 61.

Due to such a structure, the polishing liquid 2 in the polishing liquid tank 1 is prevented from contacting the active gas. Therefore, the change in the pH of the polishing liquid 2 is further reduced. Consequently, the chemical mechanical polishing characteristics are further stabilized.

EXAMPLE 3

Figure 6:
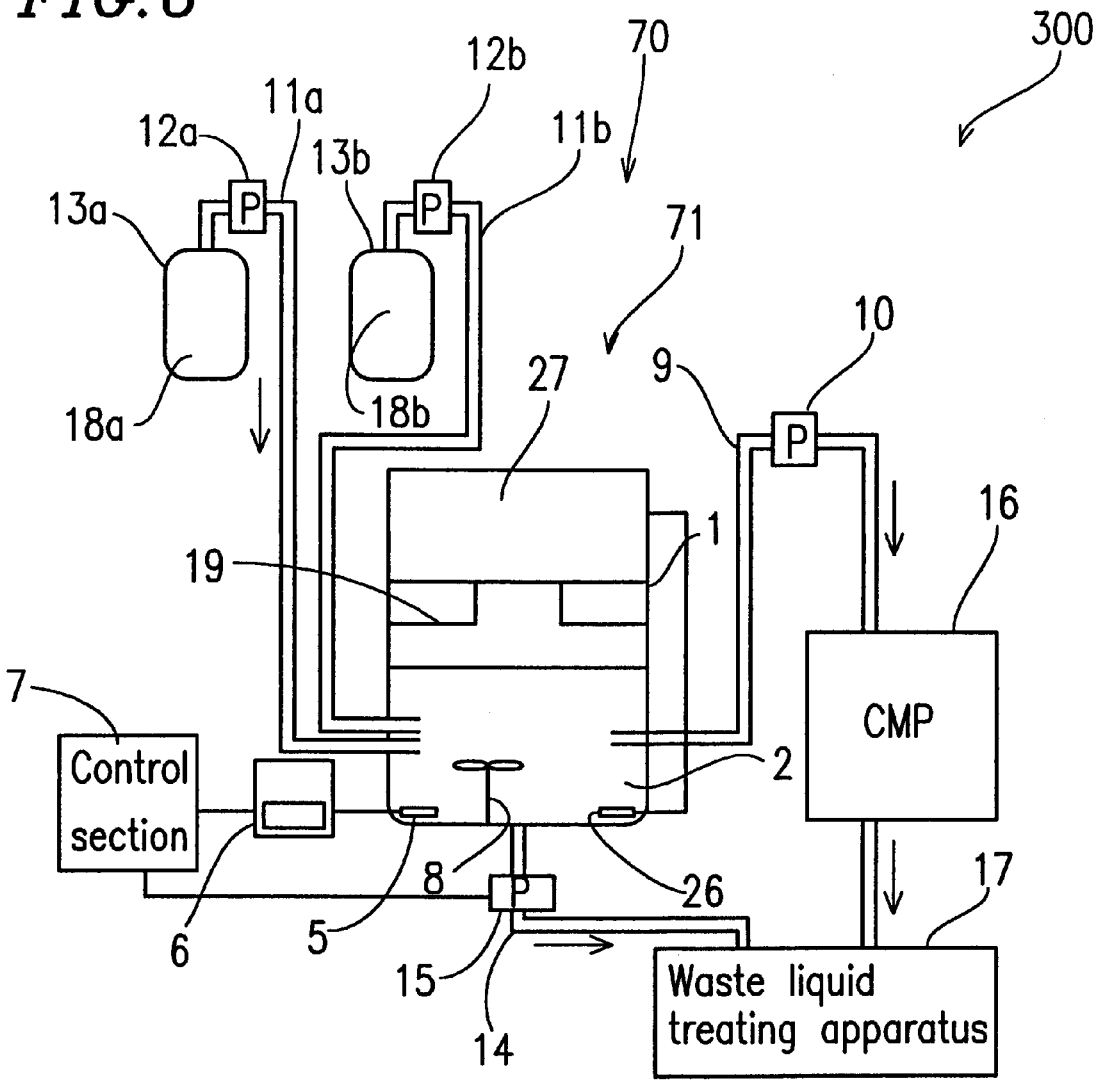
FIG. 6 is a schematic view of a semiconductor device production apparatus including a polishing liquid supply apparatus in a third example according to the present invention.
Figure 7:
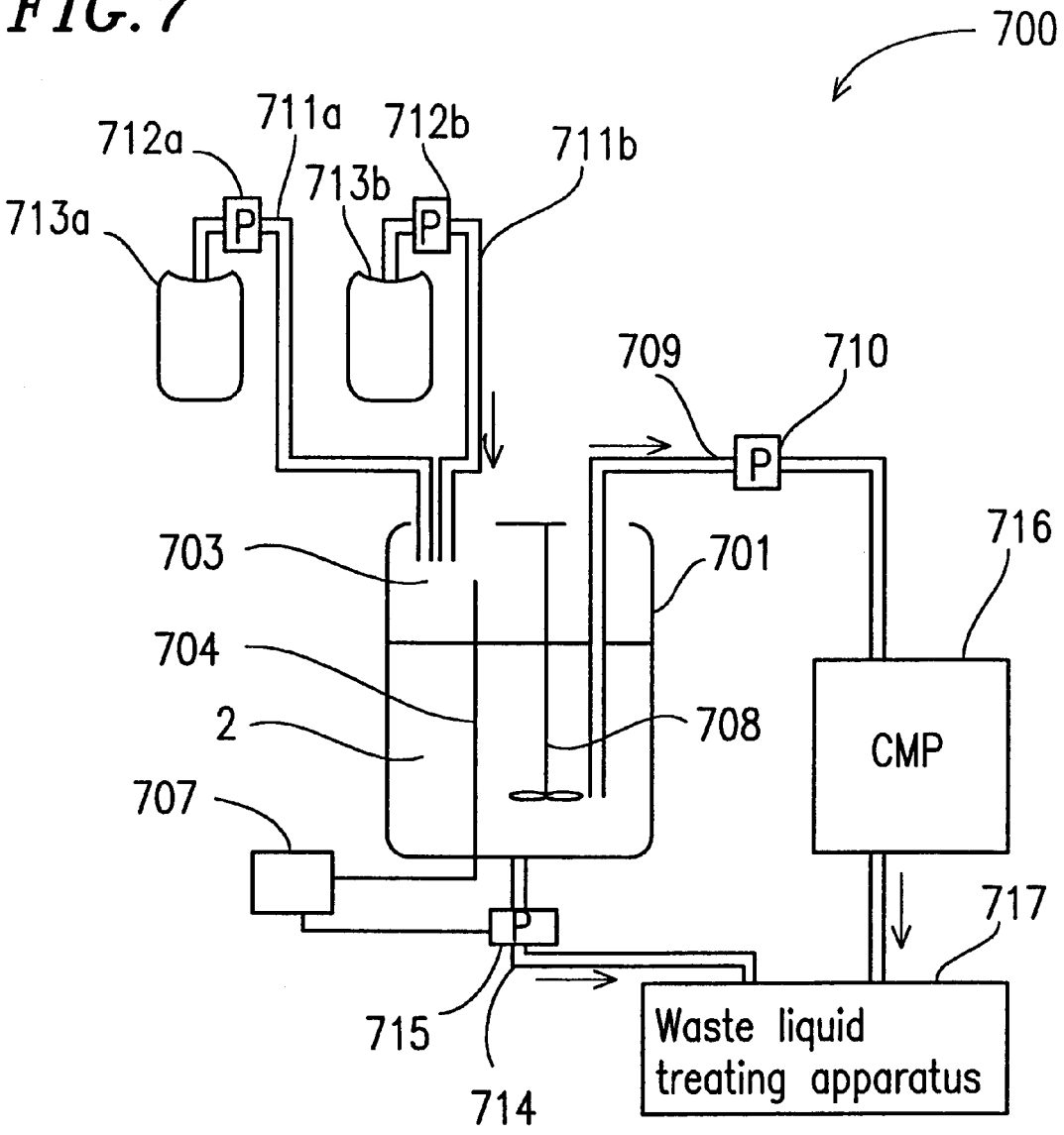
FIG. 7 is a schematic view of a conventional semiconductor device production apparatus including a conventional chemical mechanical polishing apparatus.
Figure 8:
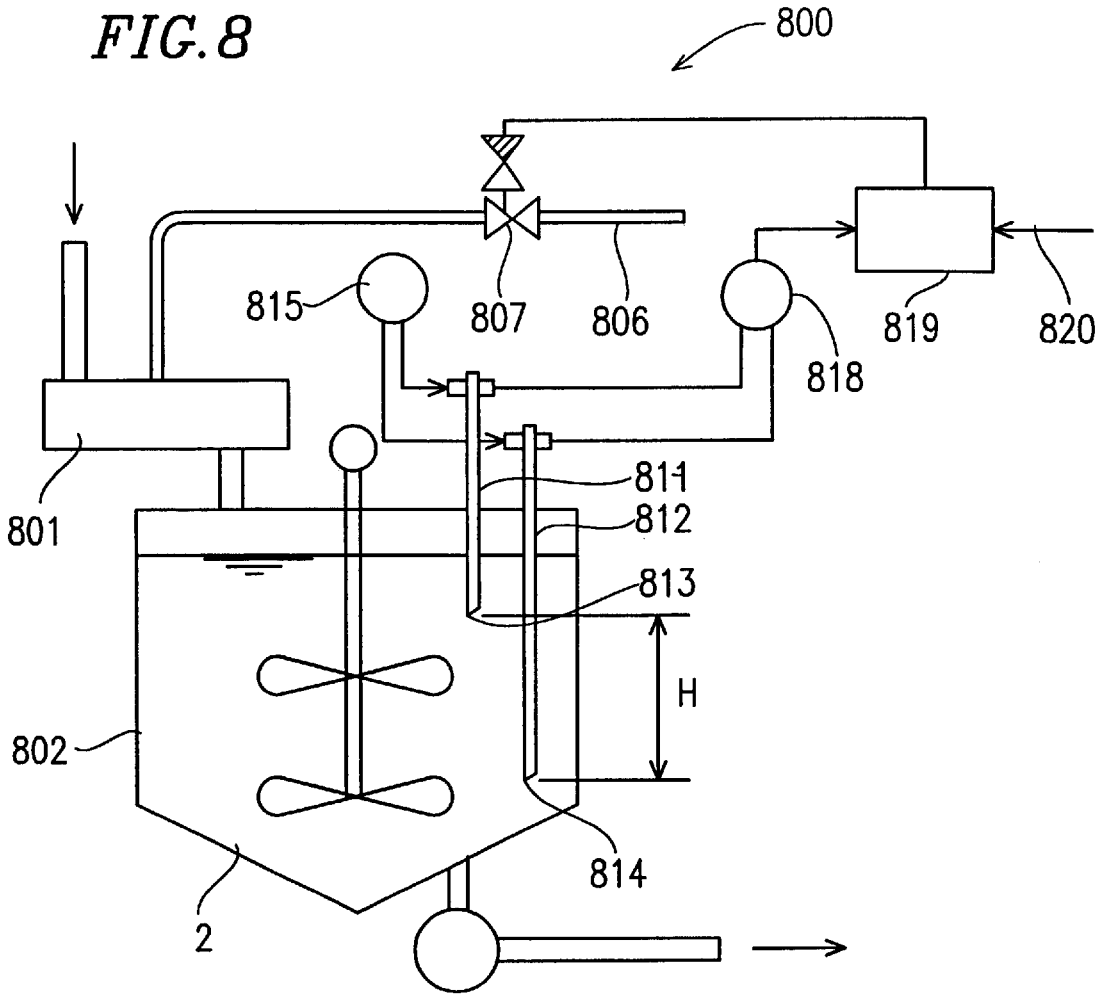
FIG. 8 is a schematic view of a conventional polishing liquid supply apparatus.

FIG. 6 is a schematic view of a semiconductor device production apparatus 300. The semiconductor device production apparatus 300 includes a polishing liquid supply apparatus 70 in a third example according to the present invention. Identical elements previously discussed with respect to FIG. 1 bear identical reference numerals and the descriptions thereof will be omitted.

The polishing liquid tank 1 has a variable capacity, so that the capacity of the polishing liquid tank 1 is always equal to the amount of the polishing liquid 2 in the polishing liquid tank 1. In this manner, the polishing liquid 2 is prevented from contacting gas.

The polishing liquid tank 1 accommodates a piston 19 resting on the polishing liquid 2. The piston 19 moves upward and downward in accordance with the amount of the polishing liquid 2 in the polishing liquid tank 1 and thus prevents the polishing liquid 2 from contacting the external air.

Alternatively, the piston 19 can be mechanically moved upward and downward so that the pressure of the polishing liquid 2 measured by a pressure sensor 26 and fedback to a control section 27 is in a prescribed range.

The polishing liquid tank 1, the pipes 9, 11*a*, and 11*b*, the pumps 10, 12*a* and 12*b*, the crude polishing liquid tanks 13*a* and 13*b*, and the piston 19 are included in a polishing liquid supply system 71.

As shown in FIGS. 3 and 4, when the polishing liquid in the polishing liquid tank 1 never contacts the external air (curve 44), the pH change of the polishing liquid is minimized. Accordingly, the polishing liquid supply apparatus 70 having the above-described structure further reduces the change in the pH of the polishing liquid.

According to the present invention, the polishing liquid in the polishing liquid supply apparatus is shielded from the external air. Thus, the change over time in the pH of the polishing liquid is suppressed, down to less than ⅕ of the case in the conventional apparatus as can be appreciated from FIGS. 3 and 4. Thus, stable chemical mechanical polishing is realized.

Since the pH of the polishing liquid in the polishing liquid tank is measured, the chemical mechanical polishing is more stabilized.

Since the change over time in the pH of the polishing liquid is predictable, the life expectancy of the polishing liquid is accurately predictable. Thus, the polishing liquid can be used for the entire life expectancy without being discharged when still usable. This decreases the number of times at which the polishing liquid is unnecessarily discharged, which reduces the cost.

Various other modifications will be apparent to and can be readily made by those skilled in the art without departing from the scope and spirit of this invention. Accordingly, it is not intended that the scope of the claims appended hereto be limited to the description as set forth herein, but rather that the claims be broadly construed.

What is claimed is:

1. A polishing liquid supply apparatus for supplying a polishing liquid to a chemical mechanical polishing apparatus, comprising:

a polishing liquid supply system including a polishing liquid tank for storing the polishing liquid; and a polishing liquid supply path for supplying the polishing liquid from the polishing liquid tank to the chemical mechanical polishing apparatus via a pump, wherein the polishing liquid supply system is structured so as to shield the polishing liquid therein from external air; and wherein the polishing liquid supply path is hermetically connected to the polishing liquid tank.

2. A polishing liquid supply apparatus according to claim 1, wherein the polishing liquid supply system is filled with an inert gas.

3. A polishing liquid supply apparatus according to claim 1, wherein the polishing liquid tank has a capacity that is variable depending on an amount of the polishing liquid in the polishing liquid tank.

4. A polishing liquid supply apparatus for supplying a polishing liquid to a chemical mechanical polishing apparatus, comprising:

a polishing liquid supply system including a polishing liquid tank for storing the polishing liquid;

a polishing liquid supply path for supplying the polishing liquid from the polishing liquid tank to the chemical mechanical polishing apparatus;

wherein the polishing liquid supply system is structured so as to shield the polishing liquid therein from external air;

wherein the polishing liquid tank has a capacity that is variable depending on an amount of the polishing liquid in the polishing liquid tank; and wherein the polishing liquid tank accommodates a piston resting on a surface of the polishing liquid and moving in accordance with a change in surface level of polishing liquid in the polishing liquid tank.

5. A polishing liquid supply apparatus for supplying a polishing liquid to a chemical mechanical polishing apparatus, comprising:

a polishing liquid supply system including a polishing liquid tank for storing the polishing liquid;

a polishing liquid supply path for supplying the polishing liquid from the polishing liquid tank to the chemical mechanical polishing apparatus;

wherein the polishing liquid supply system is structured so as to shield the polishing liquid therein from external air; and a measuring device for measuring a pH of the polishing liquid in the polishing liquid tank, and a control device for controlling a life expectancy of the polishing liquid based on the pH of the polishing liquid obtained by the measuring device.

6. The apparatus of claim 5, wherein the supply system if filled with an inert gas to shield the polishing liquid from external air in the polishing liquid tank.

7. The apparatus of claim 5, wherein a piston is provided in the tank for changing capacity of the tank, and said piston rests on a surface of the polishing liquid and moves in accordance with change in surface level of the polishing liquid in the tank.

8. The apparatus of claim 5, wherein the supply path is hermetically connected to the polishing liquid tank.

9. A polishing liquid supply apparatus for supplying a polishing liquid to a chemical mechanical polishing device, comprising:

a first tank including a liquid;

a polishing liquid tank for storing the polishing liquid;

wherein the first tank is hermetically connected to said polishing liquid tank; and wherein said polishing liquid tank is hermetically connected to said chemical mechanical polishing device via a pump.

10. A polishing liquid supply apparatus for supplying a polishing liquid to a chemical mechanical polishing apparatus, comprising:

a polishing liquid supply system including a polishing liquid tank for storing a polishing liquid mixture of at least first and second polishing liquids; and a polishing liquid mixture supply path for supplying the polishing liquid mixture from the polishing liquid tank to the chemical mechanical polishing apparatus via a pump, and wherein the polishing liquid mixture supply system is structured so as to shield the polishing liquid mixture therein from external air.

11. The apparatus of claim 10, wherein the polishing liquid mixture supply path is hermetically connected to the polishing liquid tank.

12. The apparatus of claim 10, wherein the polishing liquid supply system is filled with an inert gas so as to shield the polishing liquid mixture from external air in the polishing liquid tank.

13. The apparatus of claim 10, wherein said polishing liquid tank has a capacity that is variable depending on amount of polishing liquid mixture in the polishing liquid tank.

14. The apparatus of claim 13, wherein said tank accommodates a piston resting on a surface of the polishing liquid mixture and moving in accordance with a change in surface level of the polishing liquid mixture in the tank.

15. The apparatus of claim 10, further comprising a measuring device for measuring pH of the polishing liquid mixture in the tank and a control device for controlling a life expectancy of the polishing liquid mixture based on pH of the mixture obtained from the measuring device.

16. A polishing liquid supply apparatus for supplying a polishing liquid to a chemical mechanical polishing apparatus, comprising:

a polishing liquid supply system including a polishing liquid tank for storing the polishing liquid;

a polishing liquid supply path for supplying the polishing liquid from the polishing liquid tank to the chemical mechanical polishing apparatus;

wherein the polishing liquid supply system is structured so as to shield the polishing liquid therein from external air;

wherein the polishing liquid tank accommodates a piston for changing capacity of the polishing liquid tank and moving in accordance with a change in surface level of polishing liquid in the polishing liquid tank.

17. The apparatus of claim 16, wherein the supply path is hermetically connected to the polishing liquid tank.

* * * * *